US006386152B1

(12) United States Patent
Lawes

(10) Patent No.: US 6,386,152 B1
(45) Date of Patent: May 14, 2002

(54) INTERNAL COMBUSTION ENGINE

(75) Inventor: Keith Trevor Lawes, Poole (GB)

(73) Assignee: RVC Engines Limited (GB)

( * ) Notice: Subject to any disclaimer, the term of this patent is extended or adjusted under 35 U.S.C. 154(b) by 0 days.

(21) Appl. No.: 09/214,728

(22) PCT Filed: Jul. 15, 1997

(86) PCT No.: PCT/GB97/01934

§ 371 Date: Aug. 18, 1999

§ 102(e) Date: Aug. 18, 1999

(87) PCT Pub. No.: WO98/03781

PCT Pub. Date: Jan. 29, 1998

(30) Foreign Application Priority Data

Jul. 18, 1996 (GB) ..... 9615063

(51) Int. Cl.[7] ..... F02B 57/00; F02B 75/34

(52) U.S. Cl. ..... 123/43 R

(58) Field of Search ..... 123/43 R, 43 A, 123/43 AA, 43 C, 190.17

(56) References Cited

U.S. PATENT DOCUMENTS 1,390,811 A * 9/1921 Osman ..... 123/43 R
1,568,378 A * 1/1926 Gribojedoff ..... 123/43 R
3,319,615 A * 5/1967 Girerd ..... 123/43 R
4,773,364 A * 9/1988 Hansen et al. ..... 123/190.17
5,351,657 A * 10/1994 Buck ..... 123/43 C

FOREIGN PATENT DOCUMENTS

| | | |
|---|---|---|
| DE | 1176921 | * 8/1964 |
| EP | 16381 | * 10/1980 |
| FR | 2238321 | * 2/1975 |
| GB | 3899 | * of 1913 |
| GB | 239 528 | 12/1924 |
| GB | 515 073 | 11/1939 |
| GB | 574 560 | 1/1946 |

* cited by examiner

*Primary Examiner*—Michael Koczo
(74) *Attorney, Agent, or Firm*—Mintz, Levin, Cohn, Ferris, Glovsky and Popeo, P.C.

(57) ABSTRACT

The invention provides an internal combustion engine suitable for use with a model aircraft comprising an outer housing, a cylinder disposed within the outer housing and rotatable about an axis W—W, and a power transmission means comprising a reciprocable piston, a connecting shaft connecting the piston to a crankshaft having a bevel drive gear that meshes with a bevel gear ring disposed at one end of the cylinder, whereby a linear movement of the piston is converted into a rotational movement of the cylinder.

19 Claims, 4 Drawing Sheets

INTERNAL COMBUSTION ENGINE

FIELD OF THE INVENTION

The present invention relates to internal combustion engines and particularly, but not exclusively, to internal combustion engines for model aircraft.

BACKGROUND OF THE INVENTION

At present model aircraft use internal combustion engines comprising a reciprocating piston disposed within a cylinder where the energy created by the explosion of an air/fuel mixture within the cylinder causes the piston to reciprocate in a linear motion. This linear motion is converted to a rotational motion by a transmission unit. Such designs comprise a cylinder disposed transversely of the propeller shaft and which is difficult to contain within the body shell of the aircraft. In fact, no attempt is usually made to enclose the projecting cylinder.

EP-A-0016381 discloses an internal combustion engine in which the cylinder and the transmission are carried by the housing and the output is taken off the crankshaft.

SUMMARY OF THE INVENTION

According to a first aspect of the invention there is provided an internal combustion engine comprising an outer housing, a rotatable cylinder disposed within the housing, valve means to provide a communication with the cylinder space for gaseous material, a reciprocable piston disposed coaxially witi the cylinder, and a power transmission means, characterized in that a substantially linear movement of the piston is substantially converted by the transmission means into a rotational movement of the cylinder, the said cylinder comprising a rotational output drive means, the said transmission means comprising a connecting rod connecting the piston to a crank shaft and a gearing connecting the crank shaft to the cylinder.

Preferably, the cylinder is formed with at least one port providing communication with the cylinder space.

Preferably the outer housing is formed with an inlet port and an outlet exhaust port.

Preferably the outlet exhaust port extends for substantially one quarter of the circumference of the outer housing.

Preferably the outer housing is formed with a port to receive an electrical glow plug or spark plug.

It is preferable that an electrical battery is used to power the glow plug during the initial start up of the internal combustion engine. Preferably the glow plug retains sufficient heat energy from the combustion of the air/fuel mixture to aid the combustion of the subsequent air/fuel mixture. Alternatively, the battery is used to aid the subsequent combustion of the air/fuel mixture following initial start up.

Preferably the internal combustion engine is a four stroke engine.

Preferably the valve means operates by rotational indexing of the cylinder port relative to the outer housing ports.

Preferably the valve means also operates by rotational indexing of the cylinder port relative to the port receiving the glow plug. It is preferable that the indexing takes place when the compression ratio within the cylinder is at an optimum level.

It will be appreciated that the glow plug is exposed to the air/fuel mixture within the cylinder only when the cylinder port is indexed to a position adjacent to the said glow plug.

In conventional glow plug combustion engines the glow plug is permanently in contact with the air/fuel mixture in the cylinder during compression and the explosion occurs when the air/fuel mixture reaches a certain compression. The level of compression is limited to this explosion compression for a specific air/fuel mixture and glow plug temperature. It will be appreciated that the present invention is not limited by the explosion compression as the glow plug is not permanently exposed to the air/fuel mixture. The explosion occurs when the glow plug is exposed to the mixture.

Preferably the output drive means is disposed coaxially with respect to the cylinder.

Preferably the outer housing comprises a circular radially outer securing ring and a circular radially inner timing ring.

Preferably the output drive means comprises a shaft fixed to the axially outermost end of the cylinder.

Preferably the output drive means comprises a propeller detachably fixed coaxially on the shaft.

Preferably the transmission means comprises a connecting shaft suitably fixed to the piston, a crank pin, a crankshaft disposed substantially perpendicular to the axis of the piston; a drive gear wheel disposed coaxially on the crankshaft and meshing with a driven gear wheel disposed coaxially at one end of the cylinder, the arrangement being such that, in use, the drive gear wheel has a rotational speed twice that of the driven gear wheel.

The 2:1 drive ratio provides appropriate valve timing for a four-stroke engine.

Preferably the connecting shaft is fixed to the piston by a gudgeon pin.

Preferably the cylinder and piston are made from cast iron or steel. It will be appreciated that the sliding contact between the cylinder and the piston provides a sufficient gas tight seal which withstands the compression ratio provided by the internal combustion engine and the pressures produced within the combustion engine in use.

Alternatively, the cylinder is made from brass and comprises a hard chrome coating on its internal surface, and the piston is made from an aluminium alloy.

Alternatively, the connecting shaft is fixed to the piston by a universal ball and socket joint such that, in use, the piston is rotatable at substantially the same angular velocity as the rotating cylinder, and preferably the piston then comprises at least one piston ring disposed coaxially thereon.

Preferably the outer securing ring is made from an aluminium alloy. Also preferably the inner timing ring is made from a steel alloy.

Preferably the propeller provides, in use, an axial force, and the axial force is substantially transferred to the outer housing via the cylinder.

According to a second aspect of the invention, there is provided an internal combustion engine in accordance with the said first aspect of the invention, wherein said rotatable cylinder is a combustion cylinder, comprising a seal assembly for sealing a port in said rotatable combustion cylinder disposed for rotation within said outer housing, the seal assembly comprising a circular seal ring adapted to be disposed within a circular recess extending radially through the wall of the combustion cylinder, and a resilient means adapted, in use, to urge the circular seal ring in a radially outward direction, with respect to the rotational axis of the cylinder, towards an inner surface of the outer housing so providing, in use, a substantially gas tight seal between an inner chamber of the combustion cylinder and atmosphere.

Preferably the circular seal ring has an outer surface comprising a radius of curvature substantially equal to the radius of the radially inner surface of the outer housing.

Preferably the resilient means comprises a circular resilient ring of substantially circular cross section. Alternatively, the resilient ring comprises a substantially rectangular cross-section.

Preferably the circular recess is a circular stepped recess.

Preferably the circular seal ring comprises a body portion directed towards the cylinder axis; the radial depth of the body portion being substantially less than the radial depth of the stepped recess and being in sliding contact therewith; and a tube portion depending from the body portion and being of a thickness substantially less than the body portion and being in sliding contact with the wall of the stepped recess.

Preferably the resilient ring is housed in the stepped recess.

It is preferable that the circular seal ring is made from a phosphor bronze material. Alternatively, the circular seal ring is made from a cast iron material.

Preferably the resilient ring is made from Viton™. Alternatively, the resilient ring is made from a silicone rubber material.

Preferably the internal combustion engine is suitable for and intended for use with a model aircraft.

According to a third aspect of the invention there is provided a method of converting energy from an explosion or burning of a fuel or an air/fuel mixture in an engine in accordance with said first or second aspect of the invention, comprising substantially converting the explosive energy into a linear movement of the piston; converting the linear movement of the piston into a rotational movement of the cylinder and taking the output drive from the rotating cylinder to provide an output drive means.

Preferably the output drive means comprises a propeller detachably fixed coaxially on the shaft wherein the output drive from the cylinder is used to rotate the propeller to create forward thrust.

Various embodiments of the invention will now be described, by way of example only, with reference to the accompanying drawings in which:

DETAILED DESCRIPTION OF THE DRAWINGS

Figure 1:
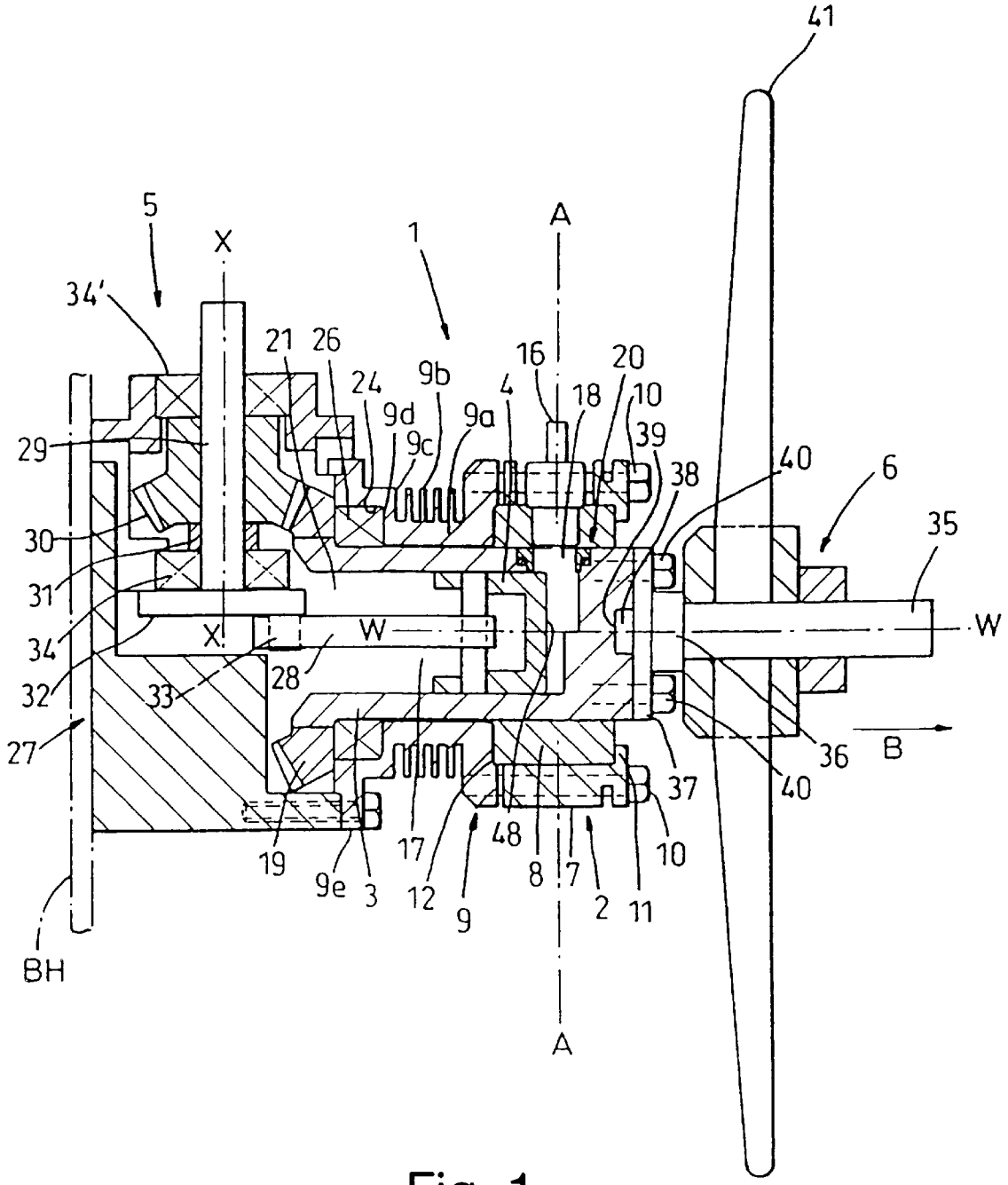
FIG. 1 shows a longitudinal cross-sectional view of an internal combustion engine for a model aircraft, with the piston substantially at 'top dead center'.

Referring to FIG. 1 an internal combustion engine 1 comprises an outer housing 2, a rotatable cylinder 3 disposed within the outer housing 2, a reciprocable piston 4 disposed coaxially within the cylinder 3, a transmission means 5 and a rotational output drive means 6 driven by the rotatable cylinder 3.

The outer housing 2 comprises a circular radially outer securing ring 7, a circular radially inner timing ring 8, and a cooling vaned section 9.

The rear end of housing 2 is secured in use to a bulkhead BH of a model aircraft.

The securing ring 7 is removably attached to the cooling vaned section 9 using bolts 10 which extend through the securing ring 7. Disposed at one end of the securing ring 7 is a radially inwardly directed flange 11. The inner radial diameter of the securing ring 7 is substantially the same as the outer radial diameter of the timing ring 8. The timing ring 8 is located between an annular abutment face 12, disposed at one end of the vaned section 9, and the flange 11, and is held in compression therebetween by the bolts 10. The amount of compressive force experienced by the timing ring 8 is controlled by tightening the bolts 10.

Figure 2A:
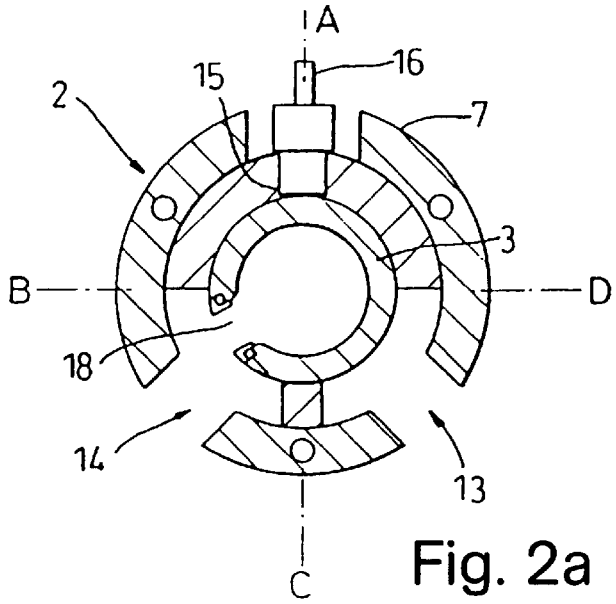
FIGS. 2*a*–2*c* show a section on the line 2*a*–2*c* of FIG. 1 and showing of the internal combustion engine at different stages of the valve indexing.
Figure 2B:
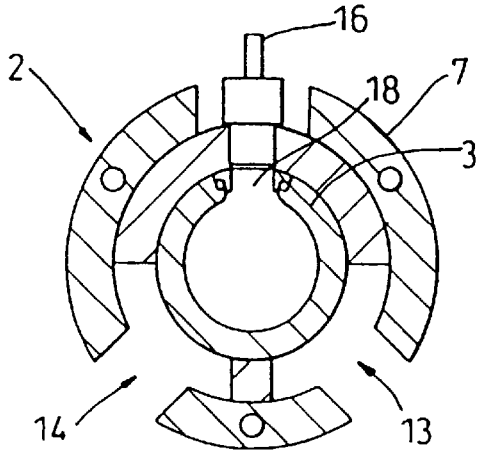
Figure 2C:
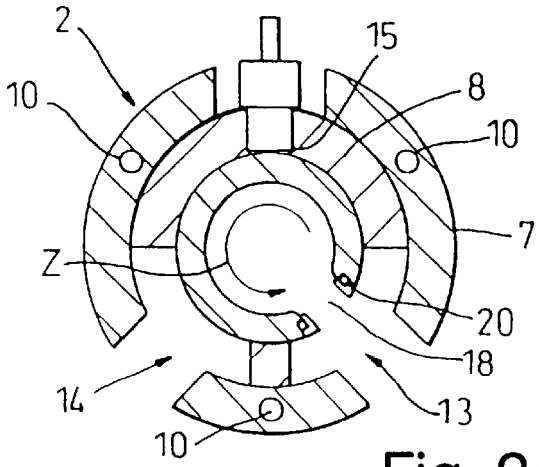

With reference to FIGS. 2*a*, 2*b* and 2*c*, the outer housing 2 is also formed with an inlet port 13 and an outlet port 14 which provide gaseous communication with the cylinder 3, and a port 15 which receives a glow plug 16.

The vaned section 9 comprises a mid-section 9*a* and a number of circumferential vanes 9*b* extending radially outwards from the mid-section 9*a*. The vanes 9*b* provide improved cooling for the engine 1. Adjacent to the mid-section 9*a* there is a stepped end section 9*c* defining a circular ring recess 9*d* and comprising a circular flange 9*e* extending radially therefrom.

The cylinder 3 is disposed coaxially within the outer housing 2, and the radially outermost surface of the cylinder 3 is in sliding contact with the radially innermost surface of the timing ring 8. The cylinder 3 defines an inner chamber 17 and a through port 18 which provides communication with the inner chamber 17; and comprises a bevel gear ring 19 disposed at an open end 21 of the cylinder 3, and a sealing assembly 20 disposed through the wall of the cylinder in such a position as to align alternately with the inlet port 13 and with the outlet port during rotation of the cylinder 3 within the outer housing 2. Abutting the bevel gear ring 19 there is a ring ball race 26 disposed within the recess 24. The ball race 26 provides radial and axial support for the cylinder 3 and allows the cylinder 3 to rotate substantially freely.

Figure 3:
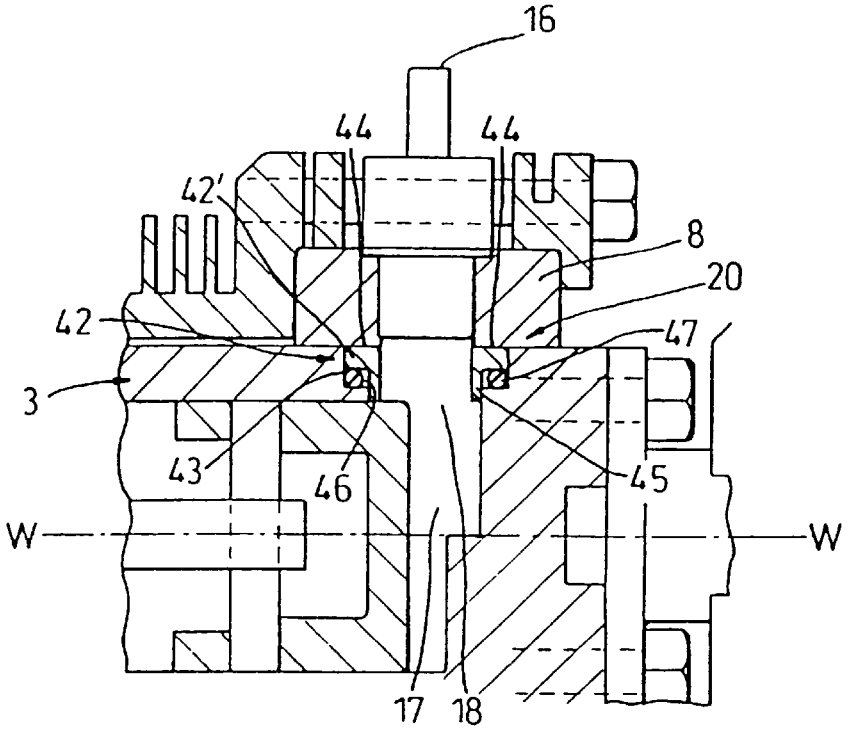
FIG. 3 shows an enlargement of a portion of FIG. 1 to show the seal assembly which effects a seal between the cylinder and the outer housing.

Referring to FIG. 3 the sealing assembly 20 comprises a circular ring 42 disposed within a stepped recess 43 which is formed within the cylinder 3. The ring 42 is in sliding contact with the stepped recess 43. The radially outermost surface 44 of the ring 42 has a radius of curvature substantially equal to that of the radially inner surface of the timing ring 8. The ring 42 comprises a body portion 421 and a depending tube portion 45 which is directed towards the cylinder axis. The tube portion 45 has a wall section substantially thinner than the body portion $\mathbf{42}^1$.

A closed ring chamber 46 is defined in the stepped recess 43 beneath the body portion $\mathbf{42}^1$ and outside the tube portion 45. The sealing assembly 20 also comprises a resilient O-ring ring 47 disposed within the ring chamber 46. The O-ring 47 urges the ring 42, radially outwards (upwards in FIG. 3) towards the radially innermost surface of the timing ring 8. The sealing assembly 20 provides a gaseous seal between the inner chamber 17 and the atmosphere when the cylinder is not aligned with the inlet port 13 or the outlet port 14.

In use the outermost surface 44 is in sliding contact with the innermost surface of the timing ring 8 as the cylinder rotates about the axis WW. The sliding contact may cause the outermost surface to be gradually worn away due to the frictional forces between the said two surfaces. The resilient O-ring 47 automatically compensates for the worn away surface by expanding so moving the circular ring 42 and the tube portion 45 towards the inner surface of the timing ring 8.

It will be appreciated that the circular ring 42 can be replaced by a new ring, if necessary, when there has been excessive wear.

Referring to FIG. 1, the power transmission means 5, which is disposed rearwardly of the rotatable cylinder 3, comprises a housing block 27, a connecting shaft 28 suitably attached to the piston 4, a crankshaft 29, a bevel drive gear 30 coaxially fixed onto the crankshaft 29, a tubular sleeve 31 disposed coaxially on the crankshaft 29 between the bevel drive gear 30 and a flat disc 32 on the inner end of the crankshaft 29. The disc 32 carries a peg 33 offset from the central axis XX of the crankshaft 29. The connecting shaft 28 is suitably attached to the peg 33 such that the substantially linear reciprocating motion of the piston 4 is converted into a rotational motion of the disc 32 about the axis XX. The crankshaft 29 is mounted within the housing block 27 by two ball races 34, 34$^1$ disposed coaxially therewith. The crankshaft 29 extends, along the vertical axis XX, from the disc 32 through the ball race 34, the sleeve 31, the bevel gear 30, and through the second ball race 34$^1$ and extends outwardly away from said ball race 34$^1$.

The outermost end of the crankshaft 29 is disposed at the rear of the engine 1, so that it is accessible whereby it may be used to start the engine 1 by using a suitable starting motor so as to rotate the crankshaft 29 about the axis XX, which axis is disposed substantially perpendicular to the rotational axis (W—W) of the cylinder 33. The user will have his/her hands behind the propeller when holding the starter motor, thereby reducing the possibility of injury.

As shown in FIG. 1, the engine has been mounted in the model aircraft with the crankshaft 29 vertical, but if desired the engine could be oriented at any convenient angle about the axis W—W of the propeller shaft.

The bevel drive gear 30 is meshed with the bevel gear ring 19. The bevel drive gear 30 has a gear ratio of 2:1 with respect to the bevel gear ring 19.

The output drive means 6 is constituted by a substantially horizontal shaft 35 which is bolted to the outer end of the cylinder 3. The shaft 35 comprises a stepped portion 36 at one end thereof, the stepped portion 36 comprising a radially extending flange 37 and a key way projection 38 which is located within a corresponding key way recess 39 provided in the outermost surface of the cylinder 3.

The output drive means 6 is secured to the cylinder 3 by bolts 40 extending through the flange 37. Fixed coaxially on the shaft 35 is an aeroplane propeller 41.

In a typical sequence of operation, the cylinder 3 and the piston 4 are relatively disposed in the positions illustrated by FIGS. 2*a*, 2*b* and 2*c*. The cylinder 3 rotates in an anti-clockwise direction shown by the arrow Z.

As the piston 4 moves substantially in a linear direction towards the open end 21, the transmission means 5 rotates the cylinder 3 and the through port 18 comes first into register with the inlet port 13, and continues to be in register for substantially a quarter revolution CD, as shown in FIG. 2*c*. While the ports are in register a suitable air/fuel mixture may enter into the inner chamber 17 via the said ports. It will be appreciated that the rotation of the cylinder will aid the mixing of the air/fuel mixture so providing a more efficient combustion. As the piston reaches the end of the stroke at the open end 21 the through port 18 has rotated through the length of quadrant CD as shown in FIG. 2*a*. As the piston reverses direction and travels in the opposite direction away from the open end 21 the through port 18 enters the quadrant DA and the outermost surface 44 comes into contact with the innermost surface of the timing ring 8 so sealing the air/fuel mixture within the chamber 17.

As the cylinder continues to rotate in the second quadrant DA the piston 4 travels away from the open 21 and compresses the air/fuel mixture within the decreasing volume defined by the inner walls of the cylinder and the surface 48 of the cylinder. As the piston reaches substantially the furthest point from the open end 21, the through port is in register with the glow plug 16, as illustrated in FIG. 2*b*, and the air/fuel mixture explodes. The glow plug 16 is used to initiate the explosion during the starting of the engine. It will be appreciated that the glow plug is used to initiate the explosion during the continual indexing of the glow plug with the through port during the running of the engine. The explosion forces the piston back towards the open end 21 and the through port 18 rotates in the third quadrant AB. The outermost surface 44 of the seal assembly 20 is in contact with the innermost surface of the timing ring 8 for the substantially part of the rotation of the cylinder through quadrant AB. The seal means is sufficient to contain the explosive pressures involved.

As the piston reaches the open end 21 for the second time the through port 18 comes into register with the exhaust port 14. The piston then reverses linear direction for a fourth time and travels away from the open end 21. At the same time the through port 18 rotates through the fourth quadrant BC. As the piston travels away from the open end 21 the burnt exhaust gases within the chamber 17 are forced through the port 18 and the outlet port 14 until the seal ring 42 reaches the end of the quadrant and comes into register with the timing ring 8 at point C. It will be appreciated that the energy produced by the combustion of the air/fuel mixture provides sufficient rotational force to drive the propeller 41. The rotation of the propeller provides an axial thrust force in the direction B in FIG. 1. The thrust force is transferred to the vaned section 9 via the cylinder 3 and the ball race 26.

The internal combustion engine is suitably attached to the structure of the model aeroplane. It will be appreciated that the said engine can be substantially housed within the cowl of the said aeroplane so having a more aerodynamic shape.

Figure 4:
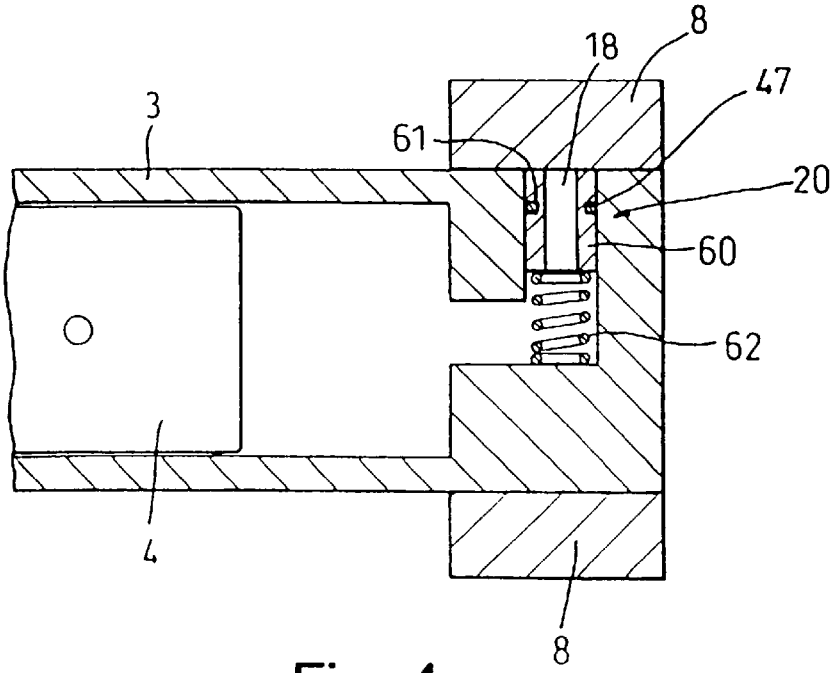
FIG. 4 shows a section view of a further embodiment of the present invention utilizing an alternative seal assembly.

FIG. 4 shows a further embodiment of the present invention and like reference numerals refer to similar parts to those of the embodiment of FIGS. 1 to 3. FIG. 4 shows an internal combustion engine 1 comprising a sealing assembly 20 comprising a tubular sleeve 60 disposed coaxially within the through port 18. The sleeve 60 is formed with a coaxial circumferential groove 61 cut into the outermost surface of the sleeve 60. Disposed coaxially within the groove 61 is the resilient O-ring 47.

The sealing assembly 20 also comprises a resilient helical spring 62 which urges the sleeve section towards the timing ring 8.

Figure 5:
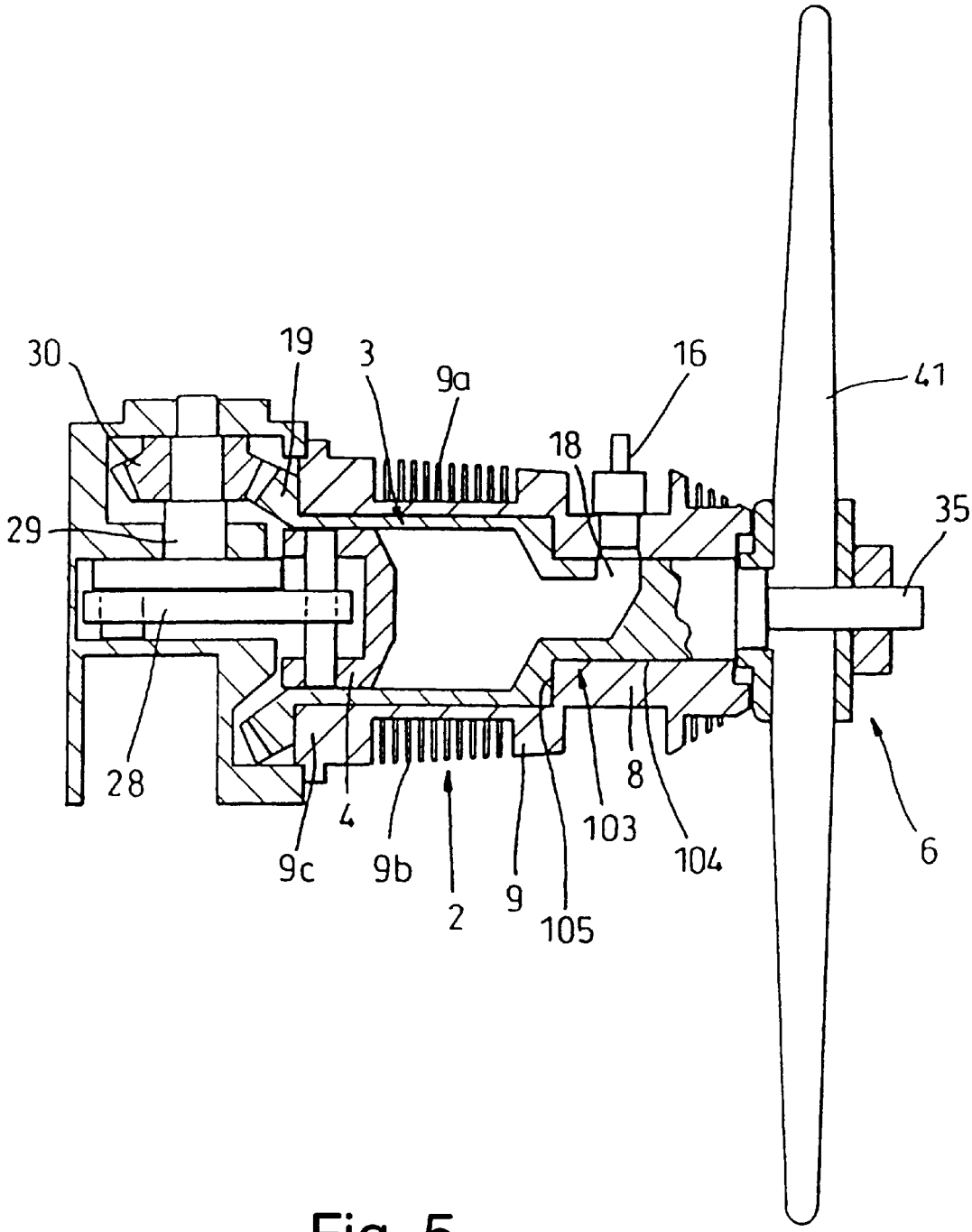
FIG. 5 is a section similar to FIG. 1 but of a modified model aircraft engine in which the cylinder head is of stepped outline, the piston being shown at bottom dead center.

FIG. 5 shows a modified engine. Parts corresponding to those of the engine of FIG. 1 have been given corresponding reference numerals.

In the construction of FIG. 5 the cylinder head 103 comprises a reduced external diameter head portion 104, an annular step 105 being defined between the main part of the cylinder 3 and the head portion 104. This enables the use of a timing ring portion 8 of reduced diameter thereby reducing the sealing surface velocity, reducing wear and torque losses due to drag in the rotary valve.

What is claimed is:

1. An internal combustion engine (1) comprising an outer housing (2);

a rotatable cylinder (3) disposed within the outer housing (2), the cylinder defining an inner chamber (17);

a valve means incorporated with the outer housing and the cylinder to provide communication with the inner chamber;

a reciprocable piston (4) disposed coaxially within the cylinder;

a power transmission means coupled with the cylinder (5) comprising a housing block (27), a crankshaft (29) disposed in the housing block, a connecting shaft (28) suitably attached at one end to the crankshaft and suitably attached at an opposing end to the piston, and a bevel drive gear (30) coaxially fixed onto the crankshaft to mesh with a bevel gear ring (19) disposed coaxially at one end of the cylinder to connect the crankshaft with the cylinder, whereby the power transmission means converts a linear movement of the piston into a rotational movement of the cylinder; and an output drive means (6) incorporated with the rotatable cylinder and disposed coaxially with respect to the cylinder.

2. The internal combustion engine of claim 1, wherein the valve means comprises at least one through port (18) formed in the cylinder.

3. The internal combustion engine of claim 2, wherein the valve means further comprises an inlet port (13) formed in the outer housing and an outlet port (14) formed in the outer housing.

4. The internal combustion engine of claim 3, wherein the valve means is constructed and arranged to operate by rotational indexing of the through port relative to the inlet and outlet ports.

5. The internal combustion engine of claim 4, wherein the outer housing further comprises a port (15) to receive a glow plug (16).

6. The internal combustion engine of claim 5, wherein the glow plug is constructed such that when power is provided to the glow plug during the initial start up of the engine, the glow plug retains sufficient heat energy from the combustion of an air/fuel mixture to aid the combustion of a subsequent air/fuel mixture.

7. The internal combustion engine of claim 5, wherein the valve means is structured and arranged to operate by rotational indexing of the through port relative to the port receiving the glow plug such that rotational indexing takes place when a compression ratio within the cylinder is at an optimum level.

8. The internal combustion engine of claim 6 is structured and arranged to operate as a four stroke engine.

9. The internal combustion engine of claim 1, wherein the output drive means comprises a shaft (35) fixed to the axially outermost end of the cylinder.

10. The internal combustion engine of claim 9, wherein the output drive means further comprises a propeller (41) fixed coaxially on the shaft in a detachable manner.

11. The internal combustion engine of claim 9, wherein the shaft is rotatable about the rotational axis (W—W) of the cylinder.

12. The internal combustion engine of claim 11, wherein the crankshaft is rotatable about an axis (X—X) disposed substantially perpendicular to the rotational axis (W—W) of the cylinder.

13. The internal combustion engine of claim 12, wherein an outermost end of the crankshaft is disposed in the housing block such that it is accessible externally from the engine, whereby a starting motor is attached to the crankshaft to rotate the crankshaft and start the engine.

14. The internal combustion engine of claim 1, wherein the bevel drive gear (30) coaxially fixed onto the crankshaft, in use, has a rotational speed above that of the bevel gear ring (19) coaxially disposed at one end of the cylinder.

15. The internal combustion engine of claim 14, wherein the bevel drive gear (30) has a rotational speed twice that of the bevel gear ring (19).

16. The internal combustion engine of claim 1, further comprising a seal assembly (20) for sealing the through port comprising a circular ring (42) structured and arranged to be received by a stepped recess (43) extending radially through a wall of the cylinder, and a resilient means (47) structured and arranged to urge the circular ring in a radially outward direction, with respect to a rotational axis (W—W) of the cylinder, towards an inner surface of the outer housing to provide a substantially gas tight seal between the inner chamber and atmosphere.

17. The internal combustion engine of claim 16, wherein the circular ring includes an outer surface (44) comprising a radius of curvature substantially equal to a radially inner surface of the outer housing.

18. The internal combustion engine of claim 16, wherein the circular ring comprises a body portion (42') directed towards the rotational axis (W—W) of the cylinder having a radial depth substantially less than a radial depth of the stepped recess, the body portion being in sliding contact with the stepped recess; and a tube portion (45) depending from the body portion having a thickness substantially less than the body portion, the tube portion being in sliding contact with a wall of the stepped recess.

19. The internal combustion engine of claim 1, wherein the power transmission means is disposed rearwardly of the cylinder.

* * * * *

UNITED STATES PATENT AND TRADEMARK OFFICE

CERTIFICATE OF CORRECTION

PATENT NO. : 6,386,152 B1
DATED : May 14, 2002
INVENTOR(S) : Keith Trevor Lawes

It is certified that error appears in the above-identified patent and that said Letters Patent is hereby corrected as shown below:

Title page,
Item [73], please change the name of the Assignee from "RVC Engines" to -- RCV Engines --.

Signed and Sealed this

Fifteenth Day of October, 2002

*Attest:*

*Attesting Officer*

JAMES E. ROGAN
*Director of the United States Patent and Trademark Office*